US005647599A

United States Patent [19]

Visger et al.

[11] Patent Number: 5,647,599

[45] Date of Patent: Jul. 15, 1997

[54] IN-LINE ROLLER SKATE BRAKING MECHANISM

[76] Inventors: Patrick Visger, 32341 Woody Ave., Fraser, Mich. 48026; Robert T. Sefton, 1547 Washington St., Birmingham, Mich. 48009

[21] Appl. No.: 560,571

[22] Filed: Nov. 20, 1995

[51] Int. Cl.[6] ..... A63C 17/14

[52] U.S. Cl. ..... 280/11.2; 280/11.22; 188/5

[58] Field of Search ..... 280/11.19, 11.2, 280/11.22, 11.21, 809; 188/5

[56] References Cited

U.S. PATENT DOCUMENTS

| | | | |
|---|---|---|---|
| 862,849 | 8/1907 | Rumble | 280/11.2 |
| 1,694,671 | 12/1928 | Rodelli | 280/11.2 |
| 4,108,451 | 8/1978 | Scheck, Sr. | 280/11.2 |
| 4,183,546 | 1/1980 | Heilig | 280/11.2 |
| 5,211,409 | 5/1993 | Mitchell et al. | 280/11.2 |
| 5,487,552 | 1/1996 | Daoust | 280/11.2 |

*Primary Examiner*—Brian L. Johnson
*Assistant Examiner*—Min Yu

[57] ABSTRACT

A braking system for an in-line roller skate includes a lever, a brake pad and a semi-rigid shaft mounted thereon. The lever is rotatably mounted on the rear wheel axle of the skate. The brake is activated by drawing the semi-rigid shaft upward, and de-activated by driving the semi-rigid shaft downward. The semi-rigid shaft can be adjusted in height to accommodate the user prior to adding a removably attached handle. As the semi-rigid shaft is drawn upward, the brake pad engages the skating surface retarding the motion of the skater. As the semi-rigid shaft is driven downward a rotation constraint provided keeps the lever from rotating into the skating surface. This rotation constraint also allows the brake to be applied using the common in-line braking method of raising the toe and pressing down on the heel. Frictional forces on the lever are sufficient to keep the brake in its disengaged position. The braking system can easily be added to most in-line skates without permanently altering the skate. The braking system attaches to the skate only, and has no portion attached to the user. This gives the user the freedom to move hands and legs naturally while skating, with the reassurance that an easy and effective means of braking is accessible.

7 Claims, 3 Drawing Sheets

IN-LINE ROLLER SKATE BRAKING MECHANISM

FIELD OF THE INVENTION

This invention relates to in-line roller skates, specifically to an improved method for reducing speed and/or stopping without manipulating the foot or leg, or activating by a means which is attached to both the skate and the skater's body.

BACKGROUND OF THE INVENTION

In-line skating has become a popular pastime for all ages. One nagging problem is the issue of safety, primarily in the area of providing an effective easy to use means of braking. The United States Consumer Product Safety Commission (CPSC) has reported, as of 1993, that hospitals have treated 37,000 injuries related to in-line skating. Since 1992, the CPSC has reported 5 deaths related to in-line skating. The CPSC recommends that in-line skaters take lessons, and learn how to control speed, turn, brake, and stop.

Current braking technology employs pads or rollers which are applied to the ground or directly to one or more of the wheels of the roller skate. Activation of the brakes is done by one of two general methods: The first and more common braking system utilizes a heel brake which requires the skater to move or otherwise s manipulate his/her leg and/or foot to engage the brake. Consequently, the CPSC recommends that skaters learn to stop by moving one foot in front of the other and raise the toe of the front skate while pushing down on the heel brake. A second general type of braking system utilizes ground or wheel engagable brake pads activated by hand via cables or other means which are primarily attached to the skate and the skater.

Various types of braking systems are disclosed in the art. In particular, U.S. Pat. No. 1,524,286 to Bried discloses a levered ground engagable brake used for slowing or retarding the movement of a roller skate or similar device. Bried discloses a brake for roller skates that claims an upwardly extending handle moveably secured at the side of the skate and adapted for gripping by a rider for holding the skate to the foot and adapted to activate braking upon movement of the handle. This system is employed for a unique skate of Bried's design and requires gripping of a handle by the rider at all times of skating. Moreover, this system requires both hands to be in constant contact with handles, as this is the primary means of securing the skates to the user's feet. This poses a problem in that the user cannot extend the hands away from his/her sides to maintain balance and control. Additionally, because the hands are constantly gripping the handles, braking at undesired times due to the natural movement of the arm and legs during normal skating, would appear to be a problem.

In addition to the above reference, several other references disclose hand-operated braking systems for in-line skates. In particular, U.S. Pat. Nos. 5,374,071 to Johnson; 5,411,276 to Moldenhauer; and 5,439,238 to Neal show roller skate brakes which utilize wheels or brake pads that engage the wheels of the in-line skate to provide braking. This poses a risk of premature wheel wear and degradation of control. These solutions pose serious drawbacks in that they are complicated mechanisms not easily industrialized. Furthermore, each of these solutions disclose cables that must be attached to the skater's body or otherwise gripped or held by the skater. These solutions pose safety risks, in that the cables could accidentally interfere with foreign objects during normal skating. Additionally, the braking system of Johnson does not appear to be easily adapted to modern in-line roller skates.

U.S. Pat. Nos. 4,300,781 to Riggs, 5,286,043 to Tkaczyk; 5,340,131 to Smathers et al; and 5,330,207 to Mitchell all disclose hand activated braking systems. All of these solutions involve a means of activation that is directly attached from the skate to the skater, a serious drawback that could result in entanglement with foreign objects while in use. It should be noted that Mitchell attempts to solve this problem by claiming a wireless electrical means of activation that does not require a direct mechanical connection between the skate and skater. This solution lacks simplicity of manufacture and cost effectiveness which are objects of the present invention. Furthermore, each of the above solutions require complicated multiple piece-part assemblies which are therefore difficult to industrialize and cost ineffective.

The goal of the present invention is therefore to eliminate the disadvantages of known braking systems and provide a braking system that is uncomplicated, easily adapted to various types of in-line roller skates without modification to the skate, uses an activation mechanism that is not attached to the skater, and can be activated by a means that does not require repositioning of the legs or feet. Activation of the braking system of this invention is accomplished, when required, by the user engaging a handle and drawing a semi-rigid shaft upward. Neither the handle, nor the semi-rigid shaft are attached to the user.

Accordingly an object of the invention is to allow it to be attached to virtually any in-line skate by means of existing features of the skate. The method of installation is such that it can be simply completed without creating holes or otherwise permanently scaring any portion of the skate. The result is a braking system that can be easily installed and subsequently removed returning the skate to its original equipment manufactured state without permanent deformations or modifications. Moreover, a consequence of this object is a mechanism that is easily industrialized.

Another object is that the braking system need not require a means of activation attached to the skate and the skater, including cables and cable levers or other means of activation requiring attachment to the body or clothing of the skater. Therefore, the danger of interference between a foreign object and an activation means mounted to the skate and the skater does not exist. Furthermore, during the skating activity the skater does not need to continuously hold or manage a means of activation, either mechanical, or wireless electro-mechanical.

Additionally the desired in-line skate braking system is one that does not require manipulation of either of the legs or feet to activate, allowing the skater to maintain maximum control and balance.

A further object of the invention is to allow the skater to apply the brake at any time as a "standard" in-line braking system. That is to say, the skater has the option to lean his/her foot back as is the most common method of braking employed with in-line skates today. This offers the skater a means by which he/she can practice the "art" of the common method of braking, while keeping at his/her disposal a means of activation that does not require leg or foot manipulation.

Another object of the invention is to employ a system of braking that uses a braking material contacting the skating surface, eliminating any concerns of prematurely wearing the in-line skate wheels or degrading control by applying force to moving wheels.

Additionally an object of the invention is to utilize a means of braking that employs a "standard" brake pad, providing a cost effective means for replacement when the life of the brake pad is reached.

SUMMARY OF THE INVENTION

In a preferred embodiment, the in-line skate brake system of the present invention includes a lever that pivots about the axle of the rear wheel of a skate so as to bring a brake pad removably attached to the lever in contact with the skating surface thus retarding the motion of the skater. The lever is hand activated which eliminates the need for the skater to manipulate the legs or feet to activate braking.

In the preferred embodiment, the lever is attached to the outside of one (either the right or the left) of the skates via an extended axle of the rearmost wheel of the skate which acts as a pivot. Spacing means disposed between the lever and the frame of the skate provides adequate clearance between the lever of the braking system and the body of the skate such that the brake can be activated and de-activated without interference with any portion of the skate. Frictional forces between the skate framework, the spacing means, and the lever keep the brake pad clear of the skating surface until braking is desired.

The rotation of the foremost end of the lever is constrained by an extended axle of the wheel directly in front of the rear-most wheel of the skate. This allows the brake to be activated in the common method by raising the foremost point of the skate until the brake pad engages the braking surface. Moreover, this rotation constraint keeps the lever from rotating to a point where the foremost end of the lever would engage the skating surface.

The rearmost end of the lever accommodates a removably attached brake pad of a configuration that is common in the in-line skate industry and suitable to frictionally engage the skating surface.

A semi-rigid shaft is removably attached to the foremost end of the lever, upwardly extending to be within the reach of the hand of the skater. The semi-rigid shaft can deflect to an approximately horizontal position, but also has the "memory" to return to its original upwardly extended position.

A handle is removably attached to the semi-rigid shaft providing a means by which the skater can engage the semi-rigid shaft. Because the semi-rigid shaft can deflect and is not directly attached to the skater's body, the risk of accidental entanglement to foreign objects is reduced.

The brake system of this invention is activated by hand as the semi-rigid shaft is drawn upward by the skater causing the lever to rotate about its pivot engaging the brake pad to the skating surface.

The brake system of this invention can be de-activated by one of two methods: First while the skater is at a complete stop, where the likelihood of a loss of control is diminished, the foremost end of the skate can be raised causing the lever of the braking system to rotate such that the foremost end of the lever comes in contact with its rotation stop. Second, the brake system of this invention can be de-activated by the hand of the skater driving the semi-rigid shaft downward causing the lever of the braking system to rotate such that the foremost end of the lever comes in contact with its rotation stop.

In summary the brake system of this invention is easily adapted to virtually all in-line skates by retrofitting two wheel axles. These modifications are by no means permanent, and the skate can be returned to its original equipment state at a subsequent time of brake removal. The brake is hand activated, allowing the skater to keep feet and legs in a coordinated position without degrading control. The brake can also be used as a "standard" in-line skate brake where the foremost portion of the skate is raised to accomplish braking. The preferred method of activation employing a semi-rigid shaft allows a safe hand activation without having to directly attach the mechanism to the skater's body. The hands and arms of the skater can be freely moved about during skating.

The foregoing and other objects, features, and advantages of the present invention will become more apparent with reference to the drawings, the detailed description of the preferred embodiment and claims.

BRIEF DESCRIPTION OF DRAWINGS

Details of the invention will become apparent from the detailed description of a particular embodiment, which is illustrated in only a non-limited way in the accompanying drawings, wherein.

DETAILED DESCRIPTION OF THE PREFERRED EMBODIMENT

Figure 1:
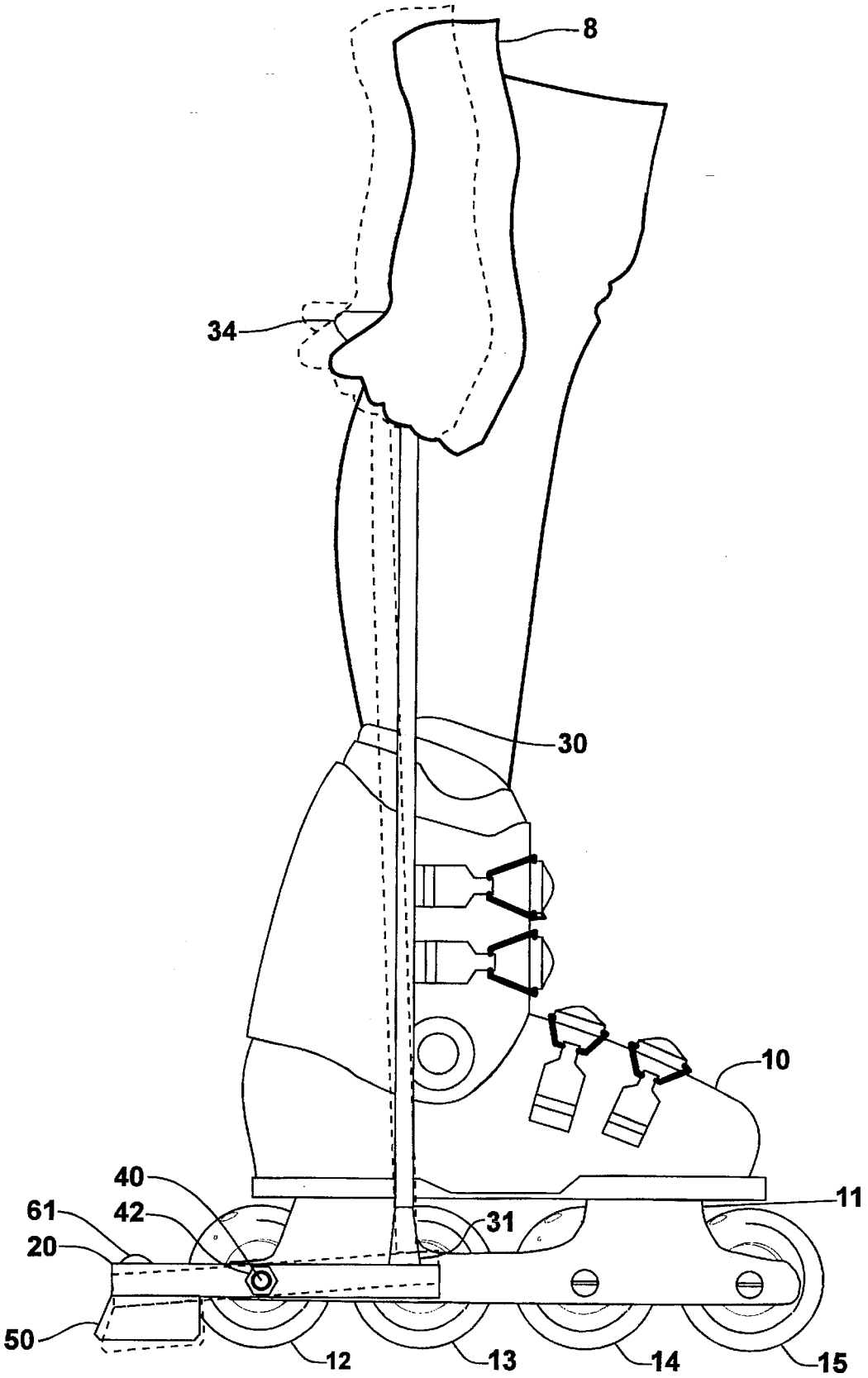
FIG. 1 is a side elevation view of an in-line roller skate having the braking system of the present invention mounted thereon, also shown is a cutaway of a person activating the braking system.

Referring to FIG. 1, a preferred embodiment of a braking system in accordance with this invention is shown for an in-line roller skate 10. The skate shown is of the typical in-line variety consisting of a plurality of rollers 12, 13, 14, and 15 mounted to frame 11.

Figure 2:
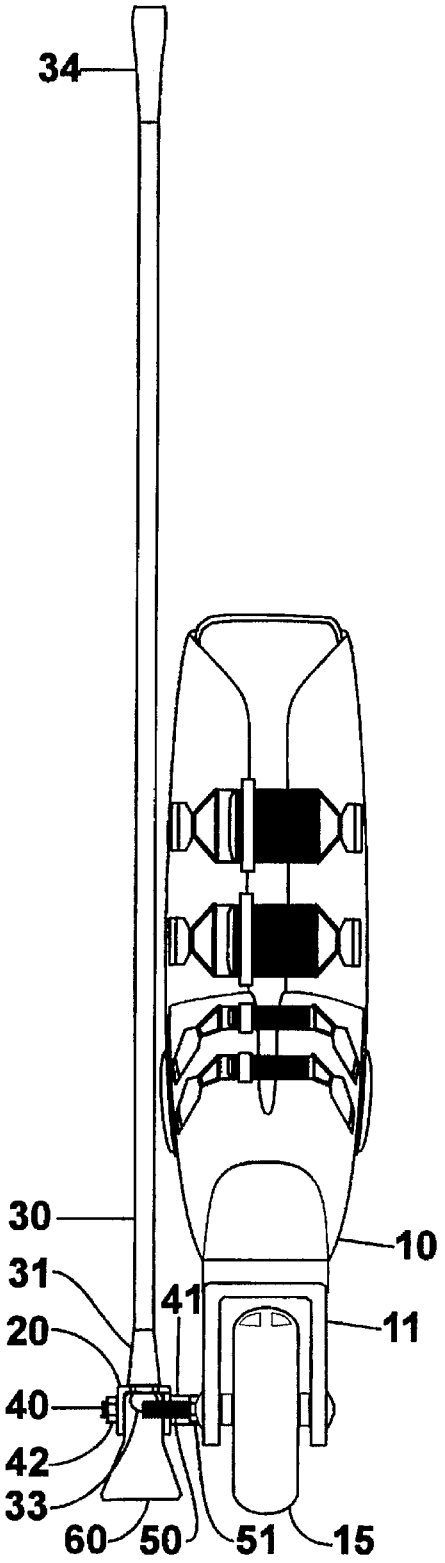
FIG. 2 is a front view of an in-line roller skate with the braking system of the present invention mounted thereon.
Figure 3:
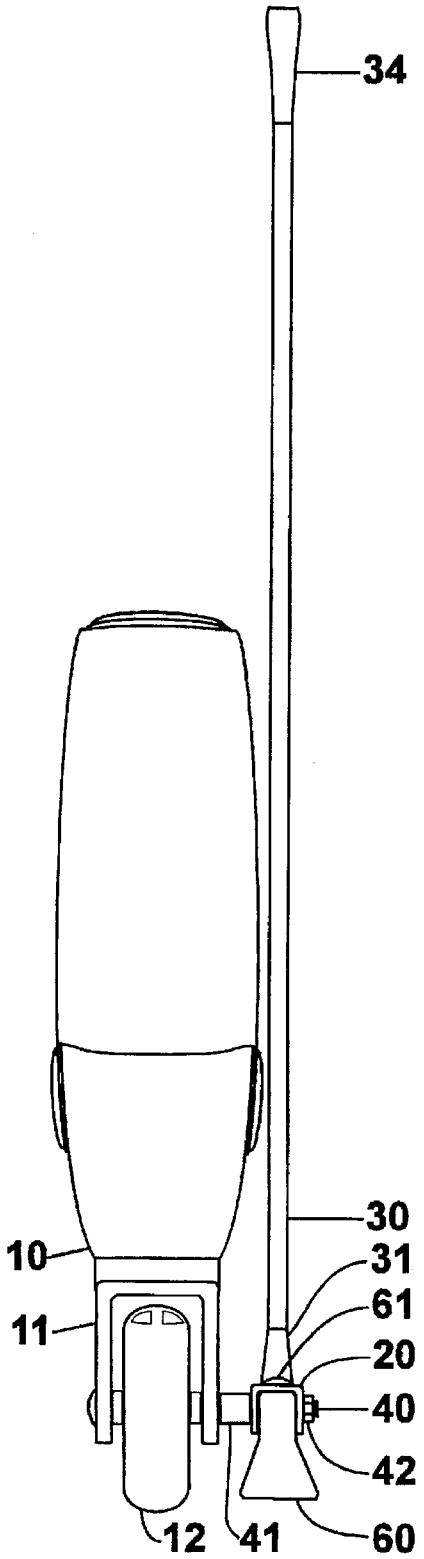
FIG. 3 is a rear view of an in-line roller skate with the braking system of the present invention mounted thereon.
Figure 4:
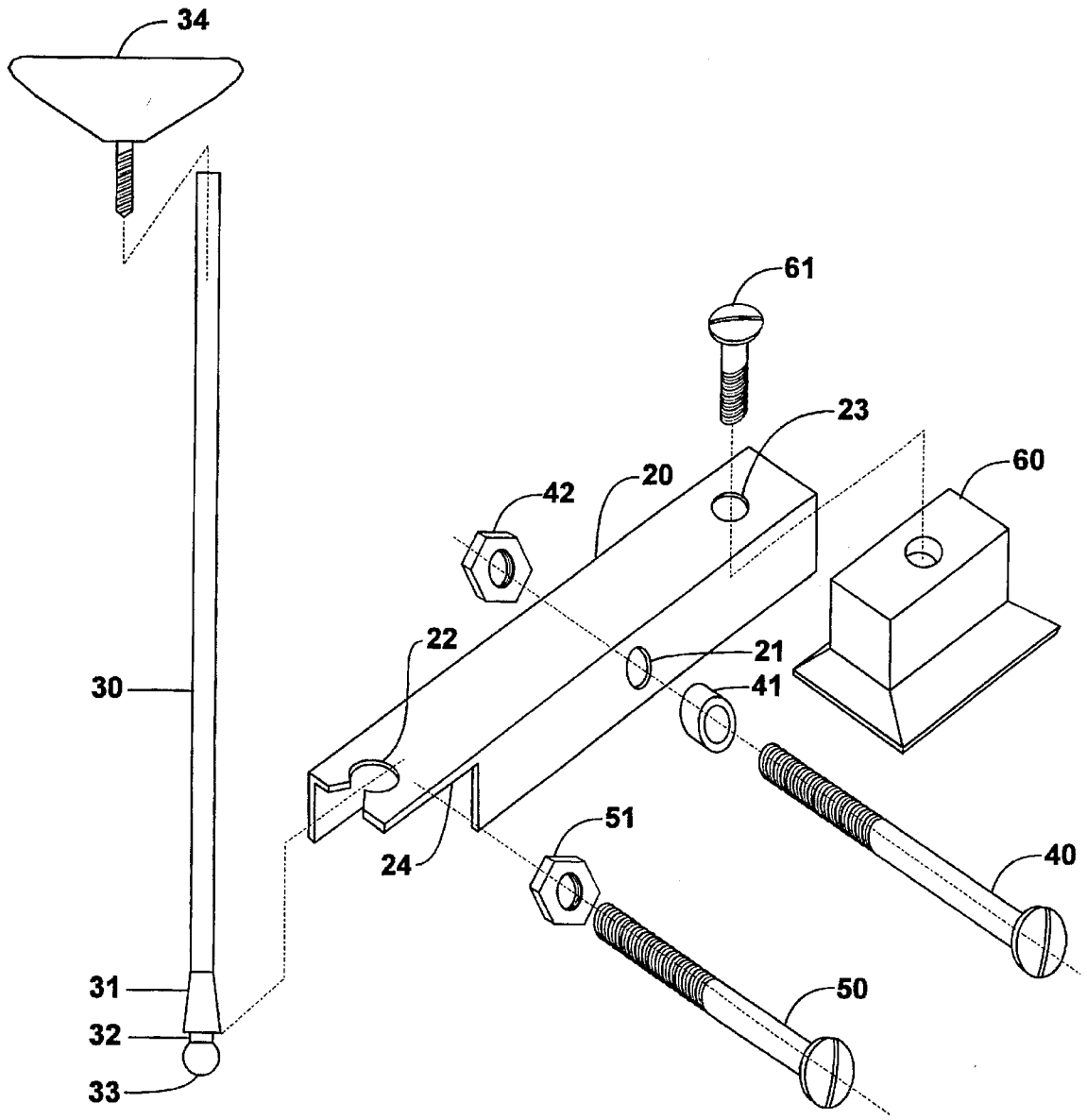
FIG. 4 is an exploded perspective view of the present invention.

The embodiment shown in FIGS. 1–4 depicts a single rigid lever 20 having a longitudinal pivot axis 21 approximately parallel o the rolling wheel axes rotatably connected to frame 11 of in-line skate 10 by way of an extended rear wheel axle 40 through the rear mounting hole of rear skate wheel 12. As it is best shown in FIG. 4, lever 20 is fitted with a pivot axis 21 to accommodate axle 40, a brake pad mounting hole 23 to accommodate mounting brake pad 60, and a hole 22 cut out at the front side with an angular lead to accommodate the attachment of semi-rigid shaft 30. Referring now to FIG. 1 it can be clearly seen that lever 20 is rotatably attached to longitudinal axle 40 which acts as a pivot. FIG. 3 shows disposed along axle 40 between lever 20 and frame 11 of in-line skate 10 is a spacing means 41, and lever 20 is operably secured to axle 40 by axle nut 42.

FIGS. 1–4 show upwardly extending semi-rigid shaft 30. The reduced section 32 of semi-rigid shaft 30 is operably attached forward of pivot axis 21 of lever 20 by pressing section 32 into hole 22 of lever 20, as is clearly shown in FIG. 4. Semi-rigid shaft 30 includes a means 31 by which it is supported above lever 20 without falling through its mating hole 22 in lever 20, and a generally spherical bottom portion 33 larger than hole 22 in lever 20.

As shown in FIGS. 1–4, handle 34 is removably attached to semi-rigid shaft 30 for drawing semi-rigid shaft 30 upward and driving semi-rigid shaft 30 downward. Semi-rigid shaft 30 can be reduced in height to accommodate a comfortable reach for user 8 prior to attachment of handle 34.

FIGS. 1–4 show brake pad 60, suitable for frictionally engaging the skating surface and having a sufficient coefficient of friction to retard movement upon contact with the skating surface, attached to lever 20 reward of pivot axis 21 through hole 23 by attachment means 61.

FIGS. 1, 2, and 4 show a means of rotation constraint 50 operably attached to skate 10 by attachment means 51 through the mounting hole of wheel 13 immediately forward rearmost wheel 12. The rotation of lever 20 is constrained such that the section 24 forward of pivot 21 does not rotate downward beyond an attitude approximately parallel the skating surface.

The preferred operation of the braking system of the present invention is depicted in FIG. 1. When braking is desired, user 8 grasps handle 22 and draws semi-rigid shaft 30 upward. This motion causes lever 20 to rotate about axle 40 from a first position wherein lever 20 is approximately parallel with the skating surface to a second position wherein brake pad 60 frictionally engages the skating surface. Spacing means 41 provides adequate clearance to allow lever 20 to freely rotate from said first position to said second position.

To disengage the brake pad from the skating surface user 8 drives down handle 34 causing semi-rigid shaft 30 to move downward rotating lever 20 from its second position until it is at an attitude approximately parallel to the skating surface and in contact with rotation constraint means 50 effectively removing brake pad 60 from the skating surface. User 8 can alternatively lift the toe of skate 10 while keeping brake pad 60 in contact with the skating surface causing lever 20 to rotate about axle 40 until it is in contact with rotation constraint means 50. When user 8 lowers the toe of skate 10 brake pad 60 will no longer be engaged with the skating surface and lever 20 will be at an attitude approximately parallel to the skating surface. Lever 20 remains in its disengaged position approximately parallel to the skating surface by means of the frictional forces between the interacting surfaces of frame 11, spacing means 41, and lever 20.

The braking system of the present invention also provides an alternate means to engage brake pad 60 to the skating surface. The alternative method of engagement is one that is common to many in-line skates of current design. In this alternative method, user 8 lifts the toe of skate 10 while keeping rear wheel 12 applied to the skating surface which causes brake pad 60 to engage the skating surface. Brake pad 60 is held firm to the braking surface as lever 20 is constrained against rotation constraint means 50. Brake pad 60 disengages the skating surface when user 8 lowers the toe of skate 10.

The materials, dimensions, and tolerances comprising the individual components of the present invention may be the most pertinent and suitable according to the specific requirements.

Although the above description of a roller skate braking system is of a particular embodiment, the invention is not intended to be limited to this particular embodiment. It is understood that to those skilled in the art, many modifications and adaptations will be readily apparent. Furthermore, this application is intended to encompass those modifications, variations, or any adaptations thereof. The invention is intended to be limited only by the appended claims.

We claim:

1. A roller skate brake system in combination with a roller skate operated on a skating surface, the roller skate having a minimum of a front and rear wheel, each rolling wheel having a circumferential surface and being rotatably mounted to a wheel axle, the brake system comprising:

(a) a single rigid lever having a longitudinal pivot axis approximately parallel to the rolling wheel axes, the pivot being rotatably connected to said skate on said rear wheel axle;

(b) a spacing means operably mounted on said rear wheel axle disposed between said lever and said skate;

(c) a rotation constraining means operably connected to said skate for constraining the rotation of said lever such that the section of said lever forward of said pivot axis rotates only above an attitude approximately parallel said skating surface;

(d) a brake pad means removably attached to said lever rearward of said pivot axis;

(e) an upwardly extending semi-rigid shaft removably attached to said lever forward of said pivot axis and;

(f) a handle means removably attached to said semi-rigid shaft for drawing said semi-rigid shaft upward causing said lever to rotate from a first position wherein said lever is approximately parallel to said skating surface and said brake pad means is above said skating surface to a second position wherein said brake pad means engages said skating surface, and for driving said semi-rigid shaft downward causing said lever to rotate from said second position to said first position.

2. A braking system of claim 1 wherein said brake pad means is suitable for frictionally engaging said skating surface.

3. A braking system of claim 1 wherein frictional forces between the interacting surfaces of said skate, said spacing means, and said lever are sufficient to hold said lever in said first position.

4. The braking system of claim 1 wherein said spacing means provides adequate clearance to allow said lever to freely rotate from said first position to said second position.

5. A roller skate brake system in combination with a roller skate operated on a skating surface, the roller skate having a minimum of a front and rear wheel, each rolling wheel having a circumferential surface and being rotatably mounted to a wheel axle, the brake system comprising:

(a) a single rigid lever having a longitudinal pivot axis approximately parallel to the rolling wheel axes, the pivot being rotatably connected to said skate on a said wheel axle wherein a spacing means is disposed between said lever and said skate;

(b) a rotation constraining means for constraining the rotation of said lever such that the section of said lever forward of said pivot axis rotates only above an attitude approximately parallel said skating surface operably connected to said skate;

(c) a brake pad means suitable for frictionally engaging said skating surface removably attached to said lever rearward of said pivot axis;

(d) an upwardly extending semi-rigid shaft removably attached to said lever forward of said pivot axis and;

(e) a handle means for drawing said semi-rigid shaft upward causing said lever to rotate from a first position wherein said lever is approximately parallel to said skating surface and said brake pad means is above said skating surface to a second position wherein said brake pad means engages said skating surface, and for driving said semi-rigid shaft downward causing said lever to rotate from said second position to said first position, removably attached to said semi-rigid shaft.

6. A braking system of claim 5 wherein frictional forces between the interacting surfaces of said skate, said spacing means, and said lever are sufficient to hold said lever in said first position.

7. The braking system of claim 5 wherein said spacing means provides enough clearance to allow said lever to freely rotate from said first position to said second position.

* * * * *